United States Patent [19]

Lichtwardt et al.

[11] 3,947,313

[45] Mar. 30, 1976

[54] PRESSURE SENSITIVE LABEL DISPENSER

[75] Inventors: Harlow E. Lichtwardt; Bruce Schrier; Frank Crutchley, all of Charlotte; Thomas White, Greensboro, all of N.C.

[73] Assignee: Rexham Corporation, New York, N.Y.

[22] Filed: Aug. 13, 1974

[21] Appl. No.: 496,974

[52] U.S. Cl. ..... 156/584; 206/396; 206/397; 229/17 S

[51] Int. Cl.[2] ..... B65D 5/72; B65D 85/67

[58] Field of Search ..... 156/584, 344, 523, 527, 156/541, 574, 577, DIG. 33; 206/389, 390, 409, 411, 395–397, 491; 221/71–73; 225/6; 229/17 R, 17 S

[56] References Cited

UNITED STATES PATENTS

| | | | |
|---|---|---|---|
| 2,373,092 | 4/1945 | Avery | 156/584 X |
| 2,723,774 | 11/1955 | Vogt | 156/527 |
| 3,107,782 | 10/1963 | Jaroff et al. | 206/390 X |
| 3,613,973 | 10/1971 | Jaeschke | 206/409 X |

*Primary Examiner*—Douglas J. Drummond
*Assistant Examiner*—M. G. Wityshyn
*Attorney, Agent, or Firm*—Mandeville and Schweitzer

[57] ABSTRACT

A folded paperboard dispenser for supporting a roll of pressure sensitive adhesive backed labels removably adhered to a release coated carrier web. The new structure includes a unique arrangement of elements which combine to protect the label roll and to dispense individual "butt-cut" or "laid-on" labels from the roll when the carrier web is drawn over and rearwardly of a special stripper tongue to delaminate and project individual pressure sensitive coated adhesive labels outwardly of the dispenser for use.

9 Claims, 3 Drawing Figures

PRESSURE SENSITIVE LABEL DISPENSER

BACKGROUND AND SUMMARY OF THE INVENTION

The tape and label dispenser art is replete with disclosures of sophisticated designs of reusable or "permanent" metal and plastic dispensing mechanisms as well as disposable paperboard dispenser carriers for adhesive tape rolls, labels, and the like. It is to a new and improved design of the latter type of dispenser that the present invention is directed.

Specifically, the structure of the present invention generally includes a one-piece paperboard blank cut, scored, folded and assembled to define an open-ended, four-walled tube having parallel front and rear walls interconnected by an arbor wall, about which the label roll is supported for rotation, and interconnected at the top portions by a dispensing label stripper mechanism including a sharply, rearwardly folded tongue member over which the carrier web may be drawn and reversed to separate and dispense individual pressure sensitive labels. In addition, the upper wall structure advantageously includes a slot through which the carrier tape may be threaded to insure proper operation of the dispenser.

In a preferred embodiment of the invention, one of the major walls of the container is substantially larger than the other to provide support and protection for large label rolls. Moreover, in certain other alternate preferred embodiments of the invention, an auxiliary, forwardly projecting catch flap may be included for rolls of labels in which laid-on labels are used rather than butt-cut labels.

For a more complete understanding of the present invention and a further appreciation of its many attendant advantages, reference should be made to the following detailed description thereof, taken in conjunction with the accompanying drawings.

DETAILED DESCRIPTION OF THE INVENTION

Figure 1:
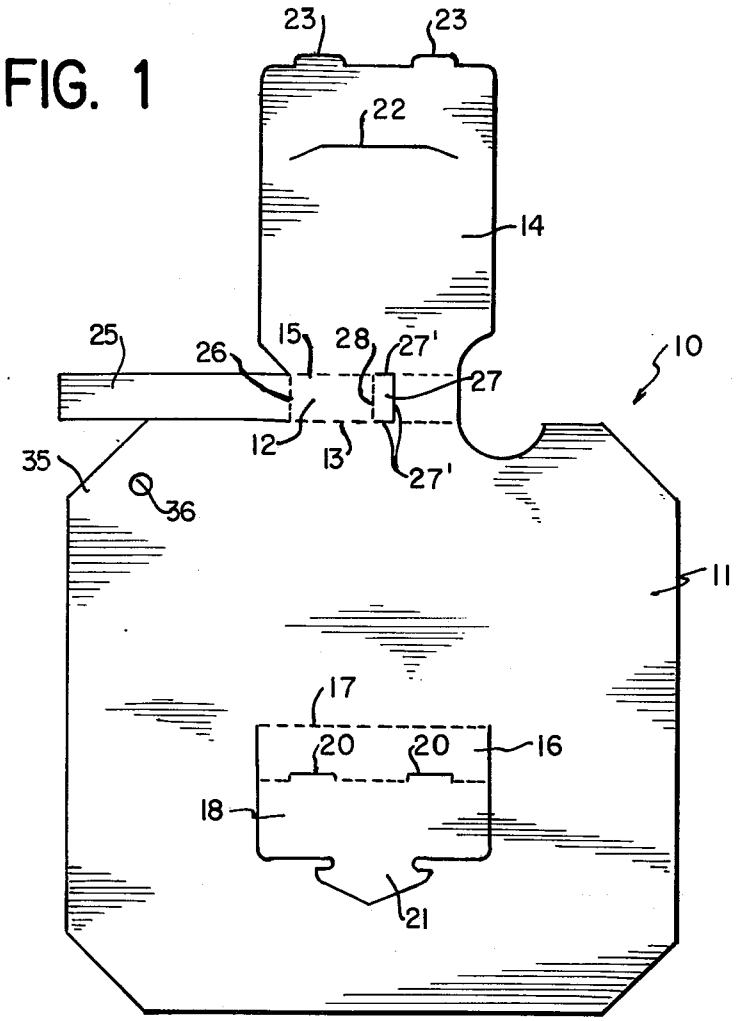
FIG. 1 is a plan elevational view of a blank from which the new paperboard dispenser may be erected.

Referring now to FIG. 1, a paperboard blank 10, from which the new improved dispenser of the invention may be erected, includes a front wall panel 11 articulated to a top wall panel 12 along score line 13 and a rear wall panel 14 articulated to the other side of said top wall panel 12 along a score line 15 parallel to said first-mentioned score line 13. The free edge of the panel 14 includes stabilizing tabs 23.

In accordance with the invention, an arbor panel 16 is articulated to the front wall panel 11 along a score line 17 parallel with the aforementioned score lines 13, 15. The lower edge of the arbor panel 16 has an assembly tab 18 articulated thereto along score line 18, which score line is interrupted by two shallow, inverted U-shaped cuts 20 which define slots 21 when the assembly flap 18 is folded, as will be understood. The free end of the assembly flap 18 includes a conventional wedge-shaped locking tab 21.

As an important aspect of the invention, an elongated stripper panel 25 is articulated to the forward edge of the top wall panel 12 along a score line 26, perpendicular to score lines 13, 15. In addition, the top panel includes a foldable, slot-forming tab 27 defined by cuts 27′ and a score line 28.

As will be readily apparent from the drawings, the locking tab 21 is adapted to be inserted into a mating, locking slit 22 formed on the rear flap 14, when the blank 10 is squared into a carton tube about a roll R of labels supported on a cylindrical core C by folding along lines 13, 15, and 17. The insertion of the locking tab 21 into the slot 22 will be automatically accompanied by the insertion of stabilizing tabs 23 into the slots 21. Thereafter, the reverse folding of stripper panel 25 will complete the erection of the open-ended dispenser 30, illustrated in FIG. 2, in which wall panels 11, 14 are parallel as are top and arbor panels 12, 16. More specifically, the aforementioned dispenser assembly is formed directly over a roll R of pressure sensitive labels 31 (butt-cut or laid-on) carried on a release coated web 32 for subsequent delamination and use. The arbor panel 16 generally locates the roll R with respect to the entire dispenser assembly and accommodates rotation of the entire roll thereabout, as to be described hereinbelow.

Figure 3:
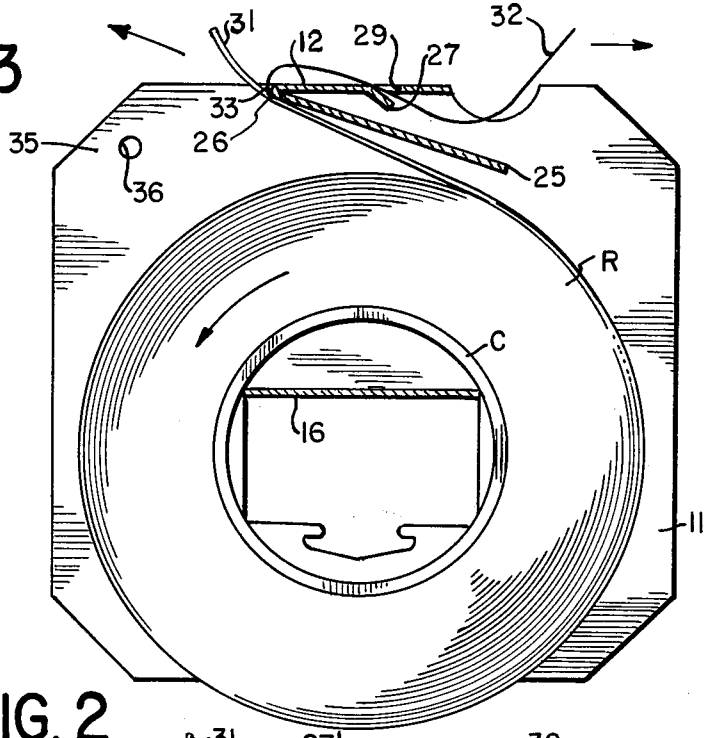
FIG. 3 is a cross-sectional view of the new dispenser assembly showing details of construction and the divergent paths of the labels and the carrier during dispensing.
Figure 2:
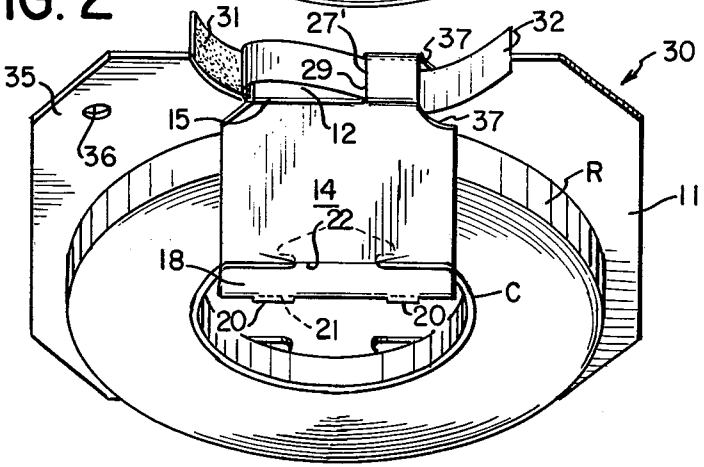
FIG. 2 is a perspective view of the new paperboard dispenser having a roll of pressure sensitive adhesive backed labels supported thereon.

In accordance with the principles of the invention, effective label-by-label dispensing of the labels 31 from the roll R may be effected by threading the carrier web 32 past the reverse folded stripper panel 25 and over a stripping crown 33, formed by the sharp junction of the stripping panel 25 with the upper wall panel 15, and down through the slot 29 formed in the upper wall by the infolding or removal of flap 27. With the carrier web 32 appropriately threaded, the front wall 11 of the dispenser unit may be secured in a horizontal position to a table or other fixed base, or the dispenser 30 may be suspended vertically or otherwise hung from the corner 35 through a hang hole 36 for operation. For example, with the dispenser held in the corner 35 by a user's left hand, the withdrawal of the carrier tape 32 rearwardly by the user's right hand, as indicated in FIGS. 2 and 3, the roll R will be rotated counterclockwise (as viewed in FIG. 3) and labels 31 will be separated from carrier 32 and projected outwardly and forwardly of the unit. If desired, an appropriate "catch tab" may be included in the path of separated labels to retain them temporarily prior to their final use. Moreover, access to the carrier may be enhanced by the formation of a relieved access opening 37 shortly spaced from the slot 29.

It will be appreciated that the dispenser 30 of the present invention is inexpensive to manufacture, uses a minimum of inexpensive materials of construction, and, therefore, may be disposed of along with empty cores C, when the supply of tape labels is exhausted. Thus, the new dispenser construction lends itself to use in applications where a large number of dispensers are used, or would be desirable for use, such as in the daily coding of parcels, with different colored labels, for example, to indicate in a department store that a bulky package or bulky item has been paid for. In these applications, the color of the "paid for" label is changed, at least on a daily basis, requiring either the changing of the roll of colored labels in a dispenser every day, or the maintenance of a multiplicity of mechanical label dispensers. Since department stores have a large number of check-out areas, there are many, many rolls of tapes which must be changed and/or stored to provide adequate security. Use of the new and improved dispensers of the invention would greatly facilitate this sort of arrangement.

While the above-described dispenser represents a preferred embodiment of the invention, it will be appreciated that other variations of the structure may be made without departing from the spirit and scope of the invention. For example, the blank shown in FIG. 1 has a front panel 11, which is substantially larger than the rear panel 14 to provide support and protection for the roll R, whereas, if desired, both panels 11, 14 may be made substantially the same size. That is to say, both may be made the size of the panel 14 or both may be made the size of the panel 11. Additionally, if desired, a carrier biasing panel, similar in shape to that of the stripping panel 25, may be articulated to the rear end of the upper wall 12, and that panel may be infolded to urge the carrier towards the roll of labels, thereby tending to control the direction of the reverse pull of the carrier by the user. Other changes, of course, may be desirable or necessary and may be incorporated without departing from the principles of the invention. Accordingly, in ascertaining the full scope of the present invention, reference should be made to the following appended claims.

We claim:

1. An improved dispenser assembly for a roll of delaminable tape including pressure sensitive labels removably adhered to a release coated carrier web, said tape being wound about a cylindrical support core, said assembly comprising a. a paperboard blank cut and scored to define rear wall, top wall, front wall, arbor wall, and connecting wall panels consecutively articulated along parallel lines of weakness;

b. said top wall having an elongated stripper panel articulated to the front edge thereof along a line of weakness extending thereacross and a transverse slot formed therein;

c. said top wall, arbor wall and stripper panels being of equal width and being of substantially equal width to that of said roll of labels;

d. said blank being folded about said roll with said arbor wall panel extending through said core, said rear wall and connecting wall panels being joined to define an open-ended carton tube;

e. said stripper panel being sharply infolded to define a stripping crown along its line of junction with the top wall panel;

f. the free end of said carrier web being threaded along said stripper panel and rearwardly over said top wall panel and then downwardly through said slot and then rearwardly of said top wall;

g. whereby the application of rearwardly directed tensile forces to said carrier web will rotate said roll about said arbor panel and will progressively delaminate said labels from said carrier web while projecting said delaminated labels forwardly of the top wall as said carrier is drawn rearwardly of the top wall over said crown.

2. The assembly of claim 1, in which a. said connecting wall panel and said rear wall panel are joined by mechanical interlocking means.

3. The assembly of claim 2, in which a. said interlocking means includes a tab means and a slit means.

4. The assembly of claim 1, in which a. said rear wall and front wall panels are of substantially different sizes.

5. The assembly of claim 4, in which a. one of said front and rear wall panels includes a hang hole in the upper front corner thereof.

6. The assembly of claim 1, in which a. said front and rear panels are relieved along upper edges thereof to provide increased access to said threaded carrier web.

7. The assembly of claim 1, in which a. said pressure sensitive labels are of the "butt-cut" type.

8. The assembly of claim 1, in which a. said pressure sensitive labels are of the "laid-on" type.

9. A blank for a pressure sensitive label dispenser comprising:

a. a paperboard sheet cut and scored to define rear wall, top wall, front wall, arbor wall, and connecting wall panels consecutively articulated along parallel lines of weakness;

b. said top wall having an elongated, inwardly foldable stripper panel articulated to the front edge thereof along a line of weakness extending thereacross and a transverse slot formed therein;

c. said top wall, arbor wall and stripper panels being of equal width and being of substantially equal width to that of said roll of labels;

d. said blank being adapted to be folded about a roll of pressure sensitive labels with said arbor wall panel extending through said roll, said rear wall and connecting wall panels being joined to define an open-ended carton tube.

* * * * *